US009603203B2

(12) United States Patent
Wilber et al.

(10) Patent No.: US 9,603,203 B2
(45) Date of Patent: Mar. 21, 2017

(54) TUBULAR WAVEGUIDE APPLICATOR

(71) Applicant: Industrial Microwave Systems, L.L.C., Harahan, LA (US)

(72) Inventors: William D. Wilber, Raleigh, NC (US); Donald B. Shuping, Pittsboro, NC (US)

(73) Assignee: Industrial Microwave Systems, L.L.C., Harahan, LA (US)

( * ) Notice: Subject to any disclaimer, the term of this patent is extended or adjusted under 35 U.S.C. 154(b) by 595 days.

(21) Appl. No.: 14/091,039

(22) Filed: Nov. 26, 2013

(65) Prior Publication Data

US 2015/0144620 A1 May 28, 2015

(51) Int. Cl.
*H05B 6/70* (2006.01)
*H05B 6/78* (2006.01)

(52) U.S. Cl.
CPC ..... *H05B 6/784* (2013.01); *H05B 6/701* (2013.01)

(58) Field of Classification Search
CPC .... D06M 10/003; D06M 10/06; D06M 11/58; H05B 11/00; H05B 6/788
USPC ..... 219/694, 690, 693, 695, 696, 679, 748, 219/762, 759, 697; 118/620, 621, 622, 118/623, 724, 727; 427/587, 251, 253, 427/62; 264/479, 288.8, 290.5, 489
See application file for complete search history.

(56) References Cited

U.S. PATENT DOCUMENTS 3,155,923 A 11/1964 Persson
3,442,663 A 5/1969 Turbak
3,457,385 A 7/1969 Cumming
3,461,261 A 8/1969 Lewis et al.
3,792,385 A 2/1974 Napoli et al.
4,006,339 A * 2/1977 Maurer ..... H05B 6/72 219/693
4,330,946 A 5/1982 Courneya
(Continued)

FOREIGN PATENT DOCUMENTS

EP 0113900 B1 11/1988
EP 2243377 A1 10/2010
(Continued)

OTHER PUBLICATIONS

International Search Report and Written Opinion of the International Searching Authority, PCT/US2014/061341, mailed Jan. 19, 2015, Korean Intellectual Property Office, Republic of Korea.

*Primary Examiner* — Quang Van
(74) *Attorney, Agent, or Firm* — James T. Cronvich

(57) ABSTRACT

A microwave heating apparatus with a tubular waveguide applicator forming a heating chamber and with microwave-transparent centering elements to maintain product to be treated in proximity to the centerline axis of the chamber. Product is conveyed through the chamber in a direction in or opposite to the direction of propagation of microwaves. Cylindrical chokes at product entrance and exit openings into the chamber prevent microwave leakage and allow for large openings for large products. In some versions, a low-loss inner tube in the chamber coaxial with the tubular applicator is used to confine product to be heated in proximity to the centerline axis of the chamber to be heated effectively by microwaves with a $TM_{01}$ field pattern.

25 Claims, 7 Drawing Sheets

(56) References Cited

U.S. PATENT DOCUMENTS

| | | | | |
|---|---|---|---|---|
| 4,497,759 | A * | 2/1985 | Nakagawa | B29C 35/12 264/288.4 |
| 5,107,602 | A | 4/1992 | Loof | |
| 5,314,647 | A | 5/1994 | Rieth | |
| 5,376,905 | A | 12/1994 | Kich | |
| 5,442,160 | A | 8/1995 | Kimrey, Jr. et al. | |
| 5,834,744 | A | 11/1998 | Risman | |
| 5,869,817 | A | 2/1999 | Zietlow et al. | |
| 5,955,126 | A | 9/1999 | Jon et al. | |
| 6,020,579 | A | 2/2000 | Lewis et al. | |
| 6,322,832 | B1 | 11/2001 | Schiffmann | |
| 6,326,039 | B1 | 12/2001 | Schiffmann et al. | |
| 6,833,537 | B2 | 12/2004 | Risman et al. | |
| 7,390,245 | B2 | 6/2008 | Brettschneider | |
| 8,268,129 | B2 | 9/2012 | Hammer et al. | |
| 2010/0311296 | A1 | 12/2010 | Boehmer et al. | |
| 2012/0304482 | A1 | 12/2012 | Willers et al. | |
| 2013/0098904 | A1 | 4/2013 | Harada et al. | |

FOREIGN PATENT DOCUMENTS

| | | | |
|---|---|---|---|
| JP | 2005322582 | A | 11/2005 |
| WO | 2012060348 | A1 | 5/2012 |

* cited by examiner

TUBULAR WAVEGUIDE APPLICATOR

BACKGROUND

The invention relates generally to microwave heating apparatus and more particularly to waveguide applicators for heating or drying products with microwaves.

Microwaves are often used in industrial processes to heat or dry products. For example, U.S. Pat. No. 4,497,759 describes a waveguide system for dielectrically heating a crystalline polymer drawn into a rod fed continuously through a circular waveguide applicator. The narrow waveguide applicator has an inner diameter of 95.6 mm, which limits its use to small-diameter products, such as a drawn polymer rod. For continuous heating and drying processes, in which individual products or a product strand is fed continuously through a waveguide applicator, openings are provided at opposite ends of the applicator for product entry and exit. But microwave radiation can also leak through the openings, especially if the openings are large to accommodate large-diameter products.

SUMMARY

One version of a microwave heating apparatus embodying features of the invention comprises a tubular waveguide applicator having a first end and an opposite second end and a circular cross section. The tubular applicator forms a heating chamber between the first and second ends. A waveguide feed is connected between a microwave source and the tubular waveguide applicator at the first end to propagate microwaves through the tubular waveguide applicator from the first end to the second end with a $TM_{01}$ field pattern in the heating chamber. A first cylindrical microwave choke is connected in series with the tubular waveguide applicator at the first end, and a second cylindrical microwave choke is connected in series the tubular waveguide applicator at the second end. The first and second cylindrical microwave chokes have open ends for products to be heated to enter and exit the tubular waveguide applicator. Microwave-transparent centering elements disposed along the length of the heating chamber confine the product within proximity of the centerline axis of the heating chamber.

Another version of a microwave heating apparatus comprises a tubular waveguide applicator having a first end and an opposite second end and forming a heating chamber between the first and second ends and an axis along its centerline. A microwave source supplies microwave energy into the tubular waveguide applicator. A microwave-transparent inner tube is disposed in the heating chamber coaxial with the tubular waveguide applicator. Microwave-transparent centering elements disposed along the length of the heating chamber maintain the inner tube coaxial with the tubular waveguide applicator.

BRIEF DESCRIPTION OF THE DRAWINGS

These features of the invention are described in more detail in the following description, appended claims, and accompanying drawings, in which:

DETAILED DESCRIPTION

Figure 1:
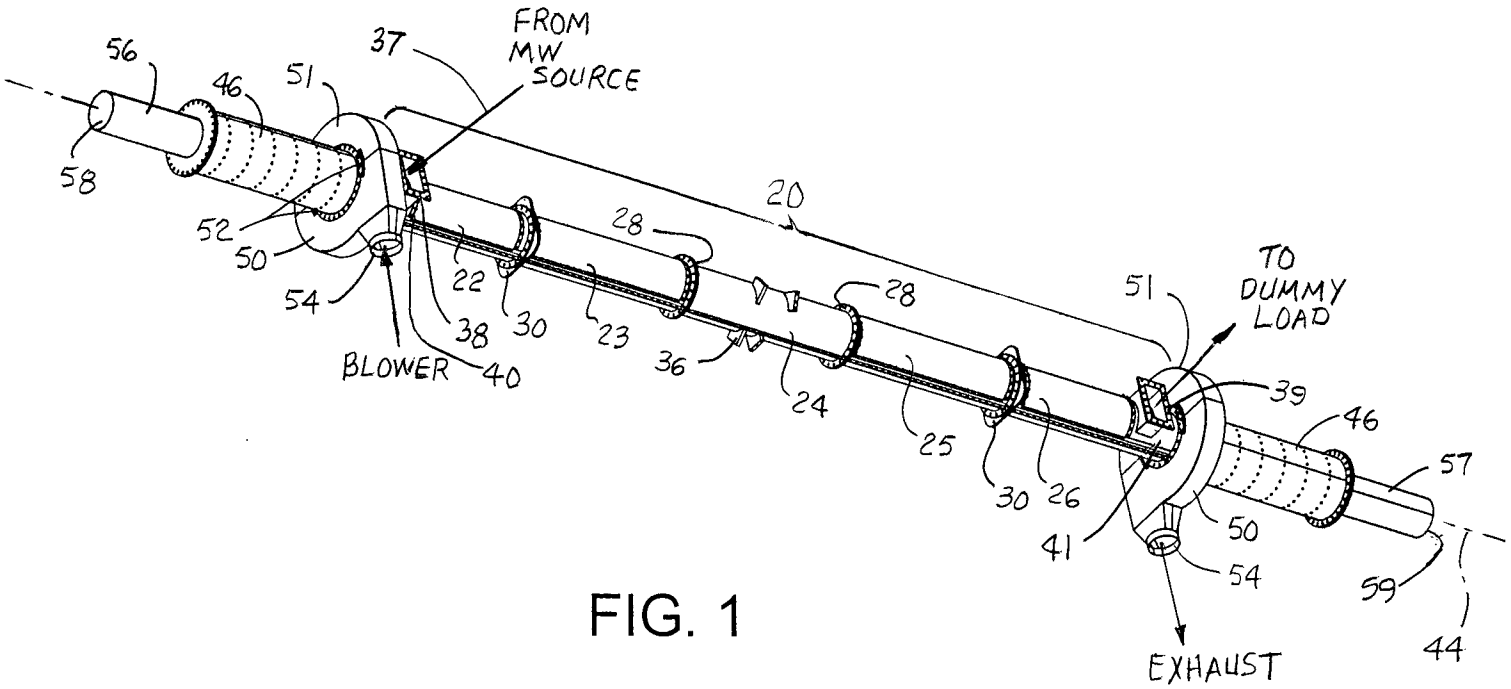
FIG. 1 is an isometric view of a tubular waveguide applicator embodying features of the invention.
Figure 2:
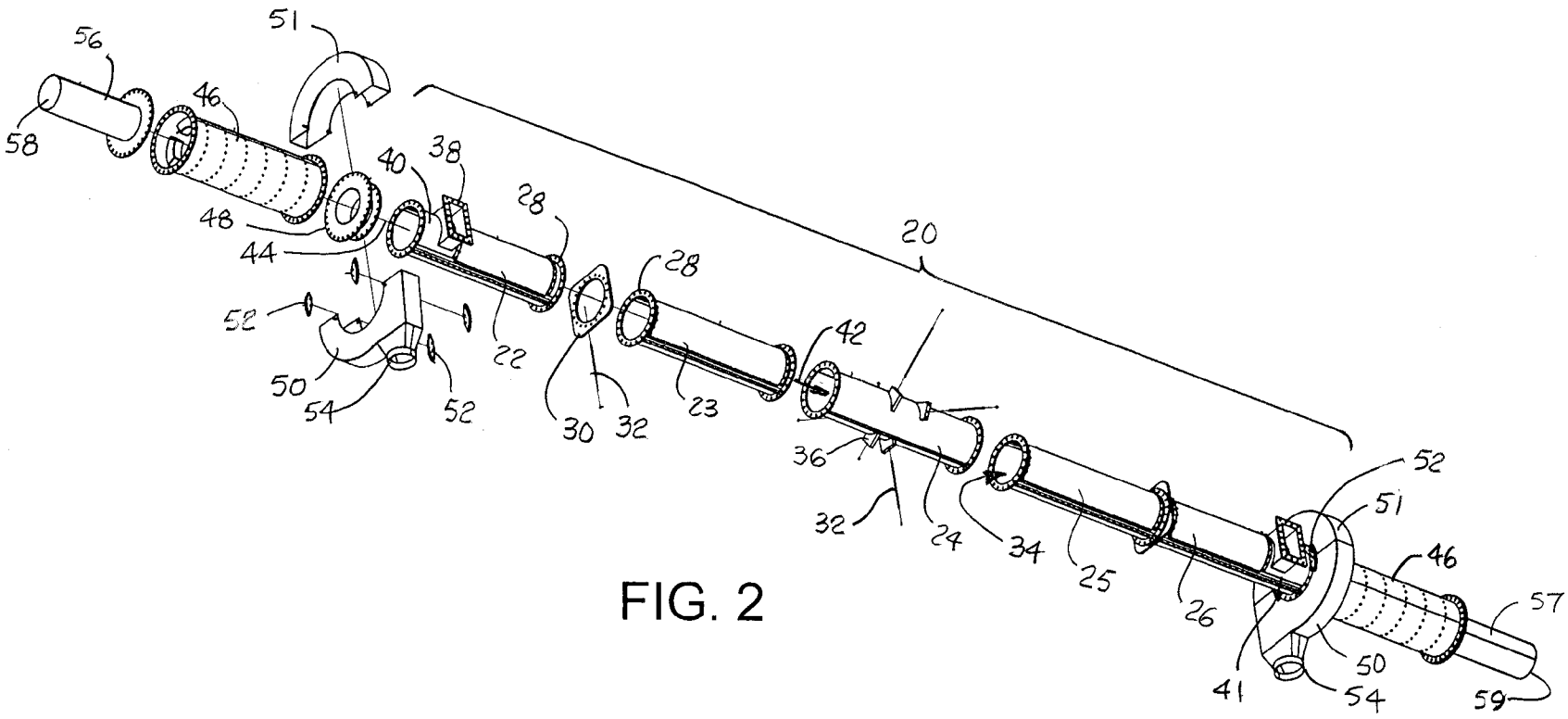
FIG. 2 is an exploded view of the waveguide applicator of FIG. 1.

A microwave heating apparatus embodying features of the invention, including a tubular waveguide applicator, is shown in FIGS. 1 and 2. The applicator 20 shown in this example comprises five circular waveguide sections 22-26 arranged in series. Each waveguide section has a circular flange 28 at each end. But the applicator could be constructed of a single waveguide section or any number of sections connected end to end. A ceramic rod support 30 is sandwiched between the facing flanges 28 of consecutive waveguide sections. Ceramic rods 32 made of an electrically insulating material, such as alumina, extend through holes in the rod supports 30 and into and through the cylindrical chamber 34 formed when the sections are bolted together. Supports 36 on the outside of the middle section 24 of the applicator also provide holes receiving the ends of the ceramic rods 32 that extend through the chamber 34. The ceramic rods, which are substantially transparent to microwaves, act as centering elements that support product strands and confine them within proximity of the axial center of the applicator. The product strands are conveyed through the chamber 34 by a conveying device, such as a motorized-reel feed and collection system (not shown) or whatever conveyor is appropriate for the particular product being heated.

A microwave source injects microwaves 37, for example, at 915 MHz or 2450 MHz, into the waveguide applicator 20 through a rectangular waveguide feed 38 at an entrance end 40 of the first tubular waveguide section 22. The microwaves propagate along the waveguide 20 from the entrance end 40 to an exit end 41 at the distal end of the last waveguide section 26. The microwaves travel through the chamber 34 in the direction of propagation 42 parallel to the axis of the chamber. Microwave energy unabsorbed by the product exits the last section 26 through a rectangular waveguide segment 39 to a dummy load, which prevents reflections back into the chamber. But it would also be possible to operate without a dummy load and allow the microwave energy to reflect back toward the microwave source and, in that way, double the effective length of the applicator. The longer sides of the rectangular waveguide feed 38, which define the feed's H plane, are perpendicular to the axis 44 of the chamber to produce a microwave field pattern in the chamber that is mainly the $TM_{01}$ mode, along with some $TE_{01}$.

The axial symmetry of the $TM_{01}$ field helps provide even heating and drying to products conveyed down the center of the tubular applicator.

Cylindrical microwave chokes 46 at each end of the chamber 34 are connected in series with the applicator at the first and last waveguide sections 22, 26 by adapters 48. Air plenum halves 50, 51 are mounted around the adapters 48 and joined by mounting tabs 52 to each other and to the adapters 48. Each of the plenums has a port 54. To keep the chamber 34 dry, air is blown in through one of the ports by a blower, flows through the foraminous adapter 48 down the length of the chamber, and is exhausted through the exit adapter and out the other port. Entrance and exit tubes 56, 57 provide openings 58, 59 to admit products into and out of the tubular chamber. Products to be treated by the waveguide applicator 20, such as strands of material to be dried, are pulled continuously through the chamber in or opposite to the direction of propagation 42 along the axis 44. The ceramic rods 32 take up sag in the product strand to keep it substantially centered in the applicator on the axis 44. The openings 58, 59 can have a diameter of 241 mm (9.5 in) to accommodate large products.

Figure 3A:
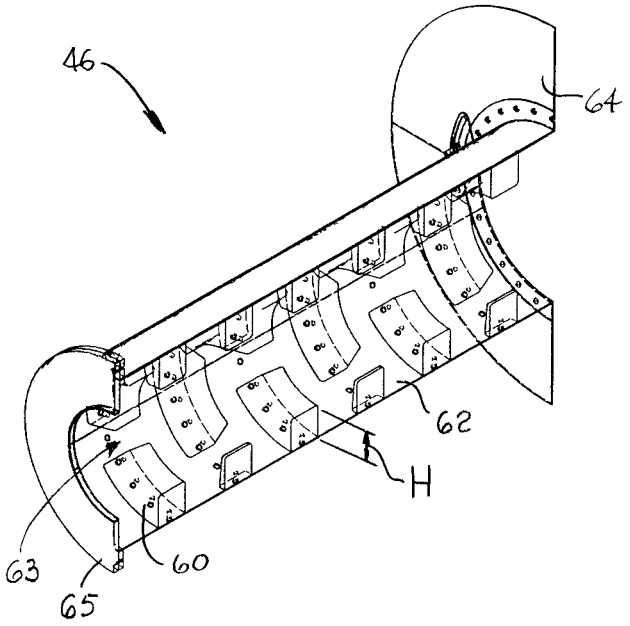
FIGS. 3A and 3B are isometric and side elevation cross sections of a choke in the applicator of FIG. 1.
Figure 3B:
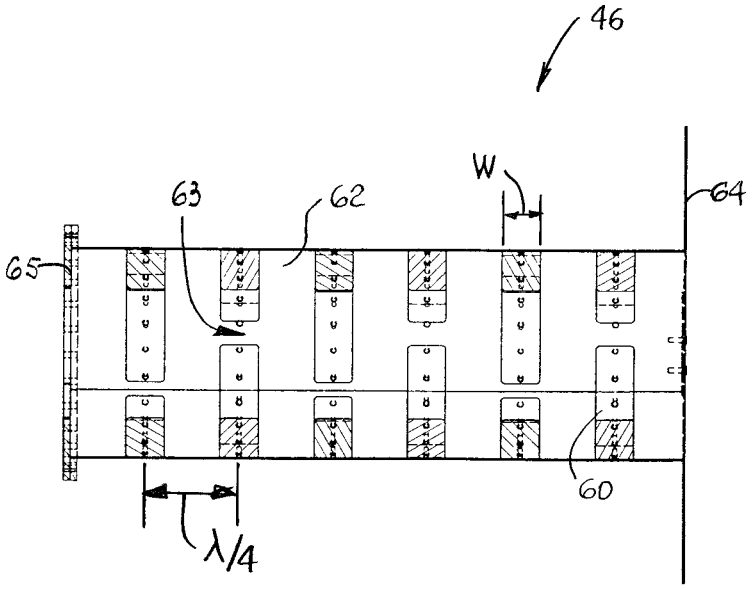

The chokes 46, as shown in half in FIGS. 3A and 3B, each include six segmented circular rings 60 extending radially inward from the inner wall 62 of the choke. The rings could be continuous annuluses, but, when segmented into arcuate segments separated by gaps 63, facilitate the manufacturing of the choke. The segmented rings 60, which are electrically conductive, are arranged coaxially along the choke at spaced apart locations, e.g., approximately every quarter wavelength ($\lambda/4$) of the microwave frequency. The gaps between consecutive segmented rings are shown in this example to be circumferentially offset to prevent their axial alignment. The width W of the rings in the axial direction of the choke in a 915 MHz system is approximately 71 mm (2.8 in); the height H of the rings in the radial direction is approximately 73 mm (2.9 in). Flanges 64, 65 at each end of the cylindrical choke 46 connect to flanges on the adapter 48 and the entrance and exit tubes 56, 57. The chokes prevent microwave energy from leaking through the openings 58, 59 in the ends of the tubes 56, 57. For narrow product that would fit through a choke having a diameter of 152 mm (6 in) or less in a 915 MHz system or 57 mm (2.25 in) or less in a 2450 MHz system, a straight pipe choke without rings could be used.

Figure 4A:
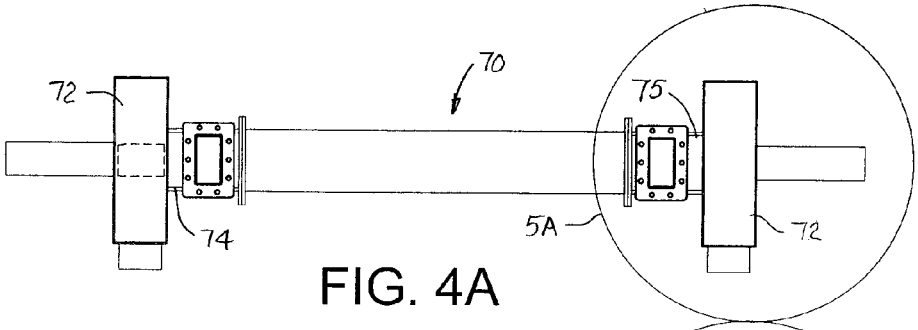
FIGS. 4A and 4B are side elevation and top plan views of another version of a tubular waveguide applicator embodying features of the invention.
Figure 4B:
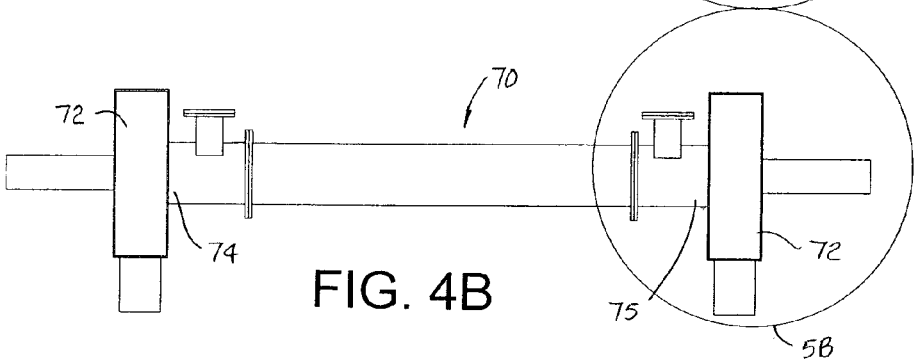
Figure 5A:
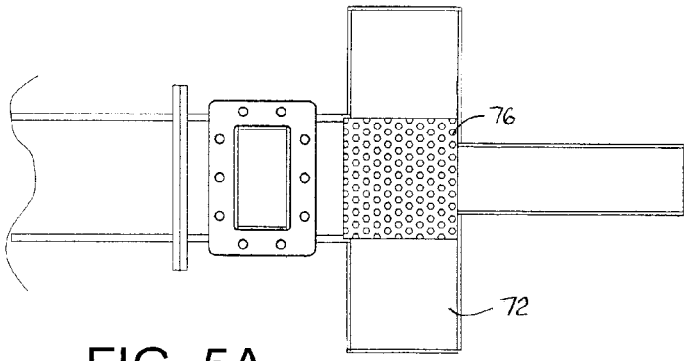
FIGS. 5A and 5B are enlarged views of the exit-end portion of the waveguide applicator of FIGS. 4A and 4B.
Figure 5B:
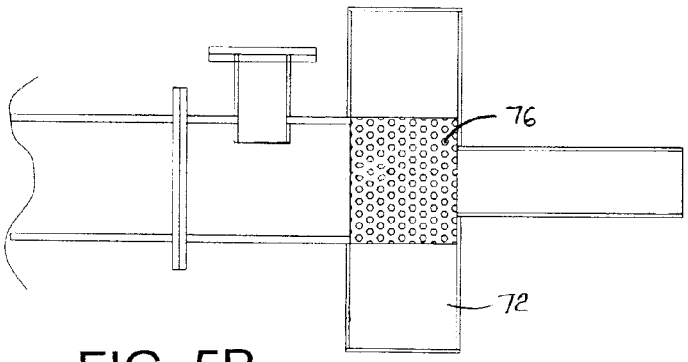

Another version of a tubular microwave applicator is shown in FIGS. 4A and 4B. The applicator 70 is similar to the applicator 20 of FIG. 1, but is smaller in diameter and shorter in length and is designed to operate at 2450 MHz. Plenums 72 are connected at opposite ends 74, 75 to the applicator 70. As shown in FIGS. 5A and 5B, the end of the circular waveguide surrounded by the plenums 72 is foraminous with many holes 76 through which air is blown into the applicator's chamber at one end and drawn out at the other end via the plenums 72.

Figure 6:
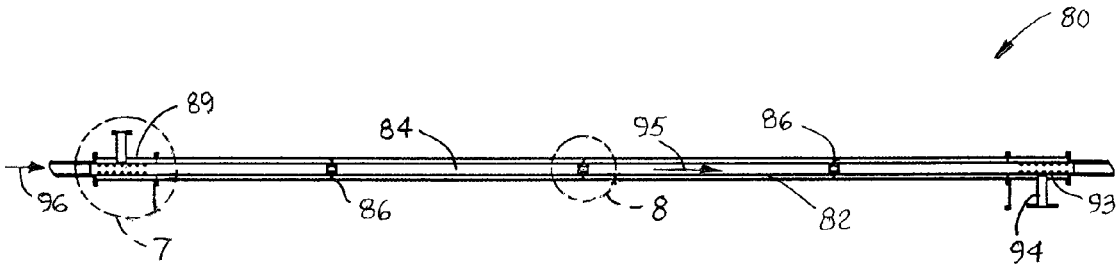
FIG. 6 is a side elevation view of another version of a tubular waveguide applicator embodying features of the invention including a transparent inner product-guiding tube.
Figure 7:
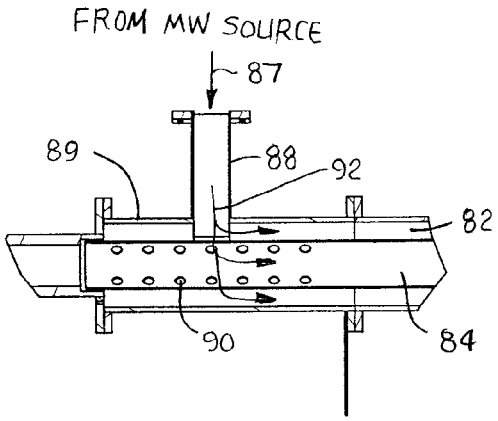
FIG. 7 is an enlarged view of the entrance end of the waveguide applicator of FIG. 6.

Another version of the tubular waveguide applicator is shown in FIG. 6. The applicator 80 is constructed of a circular waveguide forming an internal heating chamber 82 open at both ends. An inner tube 84, substantially transparent to microwaves, extends along the centerline of the applicator to contain product to be heated or cooked. Although shown only in the applicator of FIG. 6 by way of example, the microwave-transparent inner tube could be used in any of the applicators described. A conveying device (not shown) conveys the product through the applicator 80. For example, the conveying device could be a reel system conveying a product strand or a narrow conveyor belt supported within proximity of the central axis of the chamber by the inner tube. The tube 84 is made of a low-loss microwave material, such as alumina, quartz, polypropylene, or another low-loss plastic. Microwave transparent centering rings 86 having an outside diameter about equal to the inside diameter of the applicator 80 are positioned at spaced apart locations within the chamber 82. The inner tube 84 is received in the central bores of the centering rings 86 (FIG. 9), which act as centering elements supporting and centering the inner tube in the chamber. As shown in FIG. 7, microwaves 87 are directed into the applicator 80 through a rectangular waveguide feed 88 near an entrance end 89 of the applicator. Air is also supplied through the rectangular waveguide feed 88 into the heating chamber 82 and into the interior of the inner tube 84 through holes 90 formed in the end portion of the tube to create an airflow 92 along the length of the applicator. As shown in FIG. 6, the inner tube 84 has similar holes 90 at its opposite end 93 through which the air is drawn out of the inner tube and through a rectangular waveguide load segment 94 that leads to a dummy load and an air exhaust. Of course, the airflow could be arranged opposite to the direction of microwave propagation 95 and to the direction of product flow 96 by blowing air into the exit end 93 and drawing it out the entrance end 89.

Figure 8:
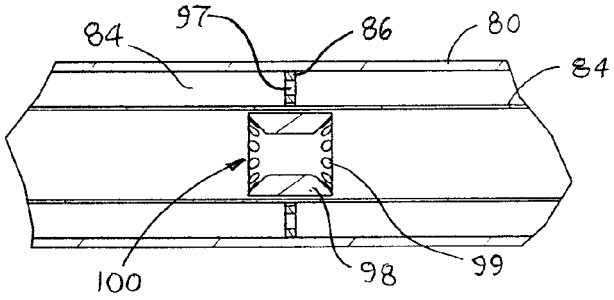
FIG. 8 is an enlarged view of a supported portion of the inner tube in the waveguide applicator of FIG. 6.
Figure 9:
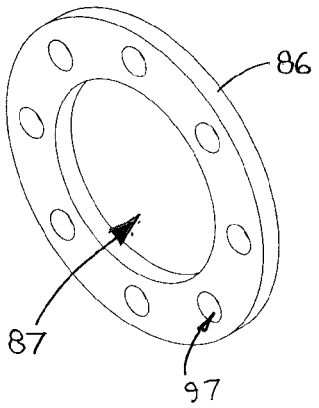
FIG. 9 is an isometric view of a support ring for the inner tube of the waveguide applicator of FIG. 6.
Figure 10A:
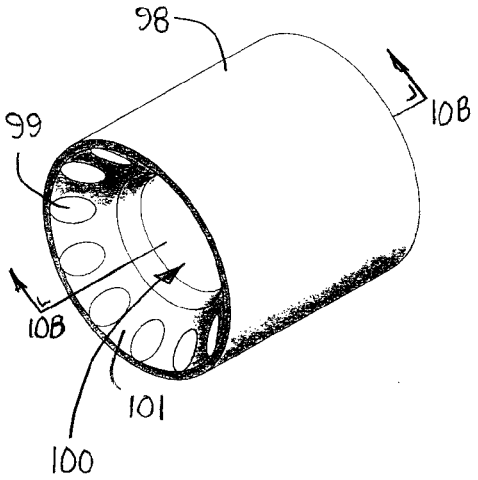
FIGS. 10A and 10B are isometric and cross-section views of a guide slug in the inner tube of the waveguide applicator of FIG. 6.
Figure 10B:
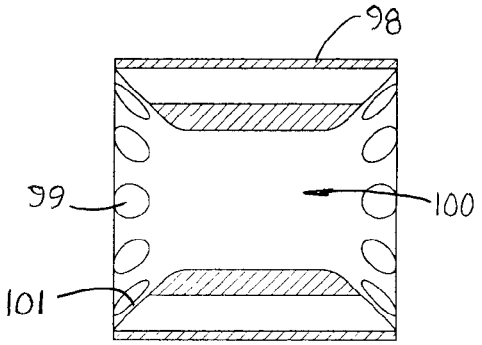

As best shown in FIGS. 8-10, the centering rings 86 supporting the inner tube 84 have through holes 97 to allow air to flow through the heating chamber 82 with minor resistance. Teflon® slugs 98 are pressed-fitted into the interior of the inner tubes 84 at the positions of the rings 86 to prevent the rings 84 from deforming the tube and to re-center sagging stranded products. Like the centering rings 86, the slugs 98, which also act as centering elements, have air holes 99 through their outer shells to allow air to pass through the tube. Each slug 98 has a central bore 100, whose periphery re-centers the advancing product strand in the tube 84. The ends of the slugs 98 are tapered inward from the outside diameter toward the central bore 100 to provide a gradual guide surface 101, without sharp edges, to the product strand entering the slug's bore. Although the exit end of the slug 98 is shown tapered and is not necessary, it makes the slug symmetrical for reversible installation.

Figure 11:
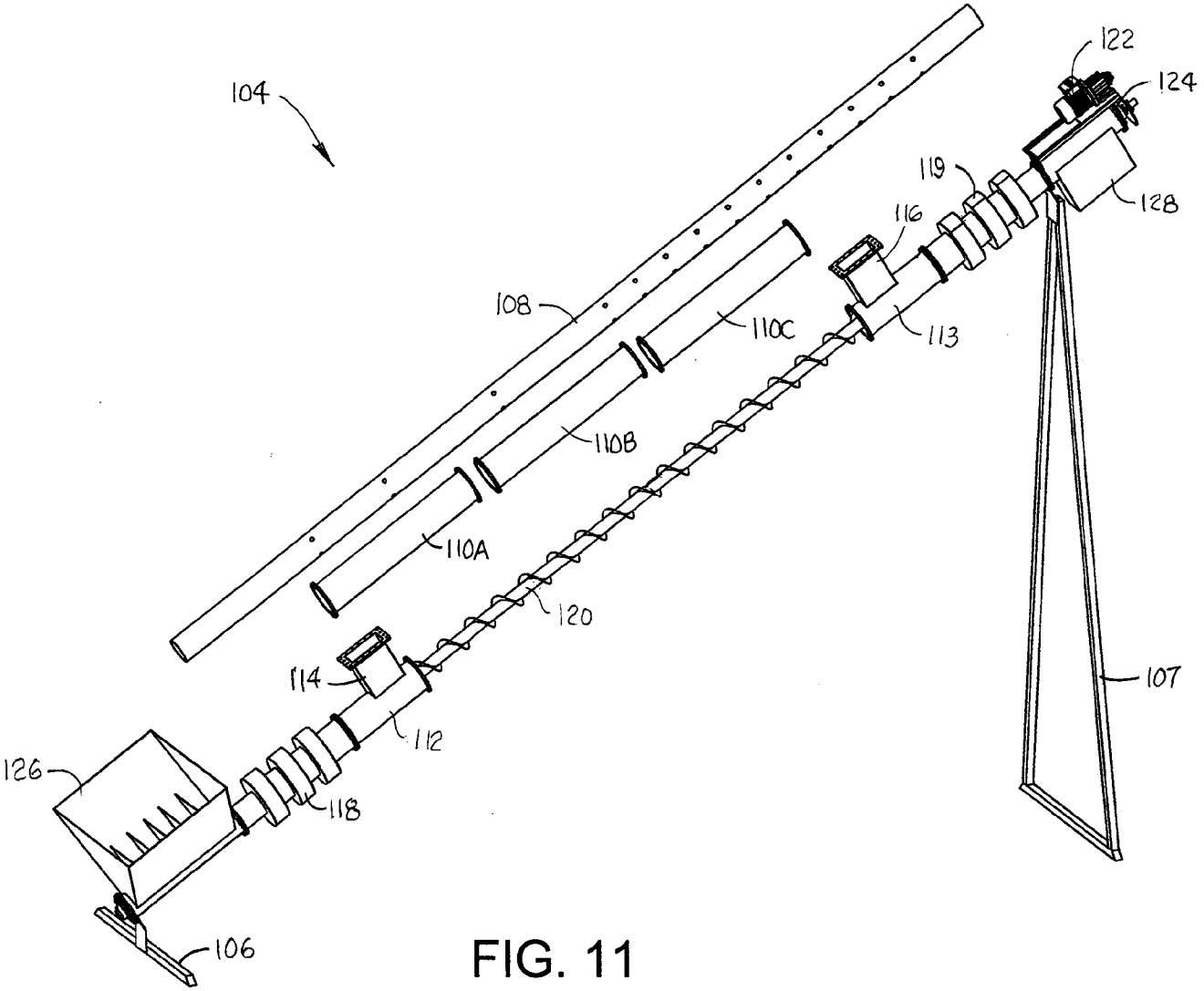
FIG. 11 is an exploded isometric view of another version of a tubular waveguide applicator embodying features of the invention including a screw conveyor.

Another version of a tubular waveguide applicator is shown in FIG. 11. The applicator 104 is supported on an incline by a short support 106 at a lower product-entry end and a tall support 107 at an upper product-exit end. Like the waveguide applicator 80 of FIG. 6, the applicator 104 of FIG. 11 has a microwave-transparent inner tube 108 supported as in FIG. 6 within an internal heating chamber formed by three circular waveguide sections 110A-C and waveguide end sections 112, 113. But the heating chamber could be constructed of one, two, or more than three waveguide sections. The inner tube 108 and the waveguide sections 110A-C are shown removed in FIG. 11 to show the interior of the chamber. Microwave energy launched into the chamber through a rectangular waveguide feed 114 connected to the lower end waveguide section 112 flows through the circular waveguide sections 110A-C and the upper-end waveguide section 113 and out the output rectangular load segment 116 to a dummy load, for example. Choke sections 118, 119 at the lower and upper ends attenuate microwave leakage. A conveying device, in this example, a screw conveyor, or auger 120, rotated by a motor 122 and gears 124 at the upper end, conveys slurries or particulate materials through the heating chamber. The rotating auger 120 draws material to be treated through an opening in the bottom of a hopper 126 and conveys it upward through the waveguide applicator 104. The microwave-treated material drops through an exit opening into a chute 128 at the upper end of the applicator.

What is claimed is:

1. A microwave heating apparatus comprising:

a tubular waveguide applicator having a first end and an opposite second end and a circular cross section and forming a heating chamber between the first and second ends with an axis along the centerline of the heating chamber;

a microwave source;

a waveguide feed connected between the microwave source and the tubular waveguide applicator at the first end to propagate microwaves through the tubular waveguide applicator from the first end to the second end with a $TM_{01}$ field pattern in the heating chamber;

a first cylindrical microwave choke connected in series with the tubular waveguide applicator at the first end and a second cylindrical microwave choke connected in series the tubular waveguide applicator at the second end, wherein the first and second cylindrical microwave chokes have open ends for products to be heated to enter and exit the tubular waveguide applicator through the first and second cylindrical microwave chokes;

microwave-transparent centering elements disposed along the length of the heating chamber to confine the product within proximity of the axis of the heating chamber.

2. A microwave heating apparatus as in claim 1 wherein the first and second cylindrical microwave chokes each include a cylindrical inner wall and plurality of conductive circular rings each extending radially inward from the cylindrical inner wall at spaced apart locations along the length of the cylindrical microwave chokes.

3. A microwave heating apparatus as in claim 2 wherein each of the conductive circular rings comprise a plurality of arcuate segments spaced apart across gaps.

4. A microwave heating apparatus as in claim 3 wherein the gaps between the arcuate segments of consecutive conductive circular rings are circumferentially offset.

5. A microwave heating apparatus as in claim 1 further comprising a dummy load connected to the tubular waveguide applicator at the second end to prevent reflections.

6. A microwave heating apparatus as in claim 1 wherein the waveguide feed comprises a rectangular waveguide radially connected to the tubular waveguide applicator and wherein the rectangular waveguide has an H plane that is perpendicular to the axis of the tubular waveguide applicator.

7. A microwave heating apparatus as in claim 1 further comprising a microwave-transparent inner tube extending coaxially through the heating chamber.

8. A microwave heating apparatus as in claim 7 comprising microwave-transparent centering elements centering the inner tube along the axis of the tubular waveguide applicator.

9. A microwave heating apparatus as in claim 8 wherein the centering elements are centering rings each having an outside diameter about equal to the inside diameter of the tubular waveguide applicator and a central bore receiving the inner tube to support the inner tube along the axis of the tubular microwave applicator.

10. A microwave heating apparatus as in claim 9 wherein the inner tube and the centering rings have air holes to allow air to flow through the heating chamber.

11. A microwave heating apparatus as in claim 8 further comprising a plurality of microwave-transparent slugs mounted in the inner tube at the locations of the centering elements, each of the slugs having a central bore coaxial with the tubular waveguide applicator for receiving and centering a product strand in the heating chamber.

12. A microwave heating apparatus as in claim 11 wherein the inner tube and the slugs have air holes to allow air to flow through the inner tube.

13. A microwave heating apparatus as in claim 11 wherein the slugs have axially opposite ends that taper inward toward from the inner tube toward the central bores.

14. A microwave heating apparatus as in claim 8 wherein the centering elements are ceramic rods.

15. A microwave heating apparatus as in claim 7 wherein the inner tube is made of a low-loss microwave material selected from the group consisting of alumina, quartz, and polypropylene.

16. A microwave heating apparatus as in claim 7 further comprising a conveying device including an auger received in the inner tube to convey product through the heating chamber.

17. A microwave heating apparatus comprising:

a tubular waveguide applicator having a first end and an opposite second end and forming a heating chamber between the first and second ends with an axis along the centerline of the heating chamber;

a microwave source supplying microwave energy into the tubular waveguide applicator;

a microwave-transparent inner tube disposed in the heating chamber coaxial with the tubular waveguide applicator;

microwave-transparent centering elements disposed along the length of the heating chamber at one or more positions intermediate the first and second ends to maintain the inner tube coaxial with the tubular waveguide applicator.

18. A microwave heating apparatus as in claim 17 wherein the centering elements are centering rings each having an outside diameter about equal to the inside diameter of the tubular waveguide applicator and a central bore receiving the inner tube to support the inner tube along the axis of the tubular microwave applicator.

19. A microwave heating apparatus as in claim 18 wherein the inner tube and the centering rings have air holes to allow air to flow through the heating chamber.

20. A microwave heating apparatus as in claim 19 further comprising an air plenum connected to the first end of the tubular waveguide applicator and wherein the air holes in the inner tube are disposed at the first and second ends of the tubular waveguide applicator and the air plenum supplies an air flow into the inner tube though the air holes at the first end and exiting through the air holes at the second end.

21. A microwave heating apparatus comprising:

a tubular waveguide applicator having a first end and an opposite second end and forming a heating chamber between the first and second ends with an axis along the centerline of the heating chamber;

a microwave source supplying microwave energy into the tubular waveguide applicator;

a microwave-transparent inner tube disposed in the heating chamber coaxial with the tubular waveguide applicator;

microwave-transparent centering elements disposed along the length of the heating chamber to maintain the inner tube coaxial with the tubular waveguide applicator; and a plurality of microwave-transparent slugs mounted in the inner tube at the locations of the centering elements, each of the slugs having a central bore coaxial with the tubular waveguide applicator for receiving and centering a product strand in the heating chamber.

22. A microwave heating apparatus as in claim 21 wherein the inner tube and the slugs have air holes to allow air to flow through the inner tube.

23. A microwave heating apparatus as in claim 21 wherein the slugs have axially opposite ends that taper inward toward from the inner tube toward the central bores.

24. A microwave heating apparatus as in claim 17 wherein the inner tube is made of a low-loss microwave material selected from the group consisting of alumina, quartz, and polypropylene.

25. A microwave heating apparatus as in claim 17 further comprising a conveying device including an auger received in the inner tube to convey product through the heating chamber.

* * * * *